United States Patent [19]

Kramer

[11] Patent Number: 4,462,216

[45] Date of Patent: Jul. 31, 1984

[54] NON-FREEZE DRAIN ASSEMBLY

[76] Inventor: Daniel E. Kramer, 2009 Woodland Dr., Yardley, Pa. 19067

[21] Appl. No.: 345,782

[22] Filed: Feb. 4, 1982

Related U.S. Application Data

[63] Continuation of Ser. No. 114,378, Jan. 21, 1980, abandoned.

[51] Int. Cl.[3] ..... F25D 21/00

[52] U.S. Cl. ..... 62/80; 62/150; 62/272; 137/59

[58] Field of Search ..... 62/285, 80, 150, 272; 237/80; 137/59, 60, 61, 62

[56] References Cited

U.S. PATENT DOCUMENTS 1,451,242 4/1923 Viberg ..... 237/80

1,610,577 12/1926 Morrell ..... 237/80

*Primary Examiner*—Albert J. Makay

*Assistant Examiner*—Henry Bennett

*Attorney, Agent, or Firm*—Daniel E. Kramer

[57] ABSTRACT

A drain assembly including a drain pipe and a heater oriented to heat the drain pipe, in combination with a defrosting type refrigeration evaporator intended for use within an enclosure whose temperature is maintained lower than the freezing point of water. The drain pipe has a discontinuity positioned in an upper portion so that defrost meltage traversing the drain tube in the ordinary course will not leak out of the pipe through the discontinuity, but that meltage backing up in the drain pipe because the drain pipe has been plugged by ice or dirt, will flow out of the discontinuity onto the freezer floor rather than backing up further into the drain pan, and the discontinuity will be maintained free of ice because it is heat transfer relation to the heater.

6 Claims, 7 Drawing Figures

(SECTION A–A OF FIG. 2)

(SECTION B–B OF FIG. 4)

(SECTION C-C OF FIG. 6)

NON-FREEZE DRAIN ASSEMBLY

This is a continuation of application Ser. No. 114,378, filed Jan. 21, 1980, now abandoned.

BACKGROUND OF THE INVENTION

1. Field of the Invention

This invention relates to the design of refrigerating evaporators and their drain systems, and especially to evaporators intended for use for cooling air in a refrigerated space whose temperature will be lower than the freezing point of water. The invention is further related to the design of heated drain systems, for these evaporators, which will not allow water to flood into the drain pan of the evaporator under conditions where the drain line has been stopped up with ice or dirt.

2. Description of the Prior Art

FIG. 1 shows an evaporator which is typical of current construction with a drain line which has water tight integrity throughout its length and opens only into the drain pan at its inlet portion to accept meltage and at its outlet end to discharge the meltage. The inventor is not aware of any related art which shows or suggests drain tubes for use in freezers which are discontinuous and where the area adjacent the discontinuity is heated so that it cannot freeze up even when the drain tube portion on the outlet side of the discontinuity is completely filled with ice.

SUMMARY OF THE INVENTION

Invention is directed toward a heated drain assembly for a refrigeration evaporator which is intended to cool air in a freezer whose temperature is maintained generally below 32° F. (0° C.). The usual drain pipes for this purpose are connected at their upper end to the outlet fitting of the evaporator drain pan and directed at their lower end to a waste point which will conduct the meltage away. The drain pipe is heated either by an electric heater traversing the length of the drain pipe or by a hot gas or warm liquid tube. The heating means are soldered to or otherwise thermally attached to the drain pipe for the purpose of maintaining that pipe above the freezing point of water throughout the defrost period. In this way meltage arising from defrost of the evaporator coil can traverse the drain pipe without freezing and reach the waste point. Such drain pipes periodically become plugged with dirt or ice and prevent the meltage from subsequent defrosts from exiting the drain tube at the waste point. Thereupon the meltage from successive defrosts accumulates in the drain tube freezing to a solid plug, positively preventing the exit of any further meltage. Eventually, the accumulated meltage backs up into the drain pan causing a pool of ice to form there. This ice in the pan acts as the nucleus for a pyramid of ice that rises up into and through the refrigerating coil. Ice in either the coil or pan or a refrigeration evaporator not only acts to sharply reduce the air flow and the cooling capacity of the evaporator but frequently causes damage to the coil tubes, fins, and the drain pan itself.

Therefore, it is an object of this invention to provide a drain assembly for an air cooling evaporator for freezers which will not allow meltage to back up into the evaporator even though the outlet of the drain pipe has been plugged.

It is further an object of this invention to provide a discontinuity in the drain pipe which is so positioned that it does not interfere with full flow of defrost meltage to waste when the drain assembly is operating normally but which is heated by the drain line heating means so that even in the abnormal condition when the outlet portion of the drain pipe is plugged with ice, the area at the location of the discontinuity remains free of ice and allows the meltage to run out over the floor of the freezer giving immediate warning of trouble rather than destructively building up into the drain pan of the evaporator.

The discontinuity can be in the form of a heated trough, one side of which is soldered to the heating tube; or a hole or a series of holes in the upper portion of the drain tube itself immediately adjacent to the line of contact between the heating tube and the drain tube; or in the form of a heated drain tube inlet which is adjacent to and beneath but not connected to the drain pan outlet, such that if the drain tube freezes up completely the water emitted by the drain outlet of the pan will simply overflow the drain tube onto the freezer floor rather than backing up into the evaporator drain pan.

DESCRIPTION OF THE PREFERRED EMBODIMENTS

Figure 1:
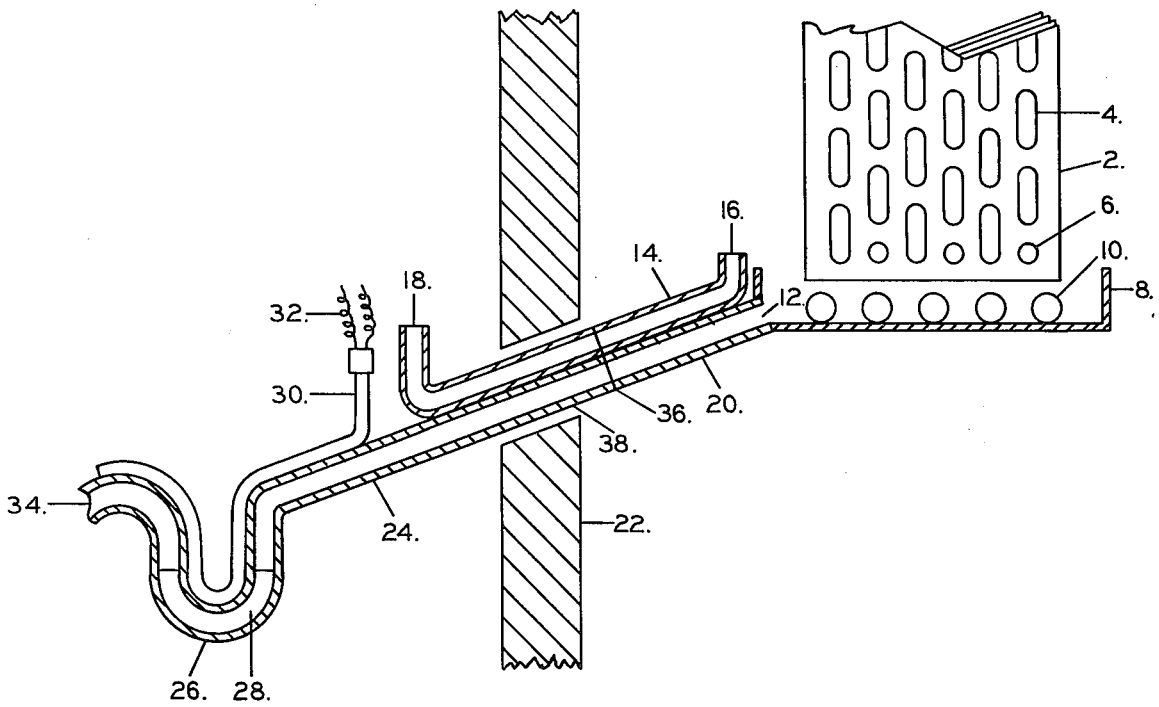
FIGURE 1 (PRIOR ART)
FIG. 1 shows a cross section in elevation of the lower portion of an air cooling evaporator coil with its heated drain pan and drain tube representative of the prior art. The drain pipe is heated at one section by a hot gas tube and at another section by an electrical heater.

FIG. 1 showing existing art is a side elevation in partial cross section of an evaporator coil positioned over a heated drain pan which in turn is connected to a heated drain line for conveying meltage resulting from the defrost of the coil to waste. Coil 2 includes fins traversed by tubes, some, 6 open at the ends, others 4 in pairs joined by return bends 4. The coil with its fins and tubes is positioned over a drain pan 8, the bottom of which is heated by heaters ten. The heaters 10 are tubes intended for the conveyance of hot gas during defrost periods; however, an equivalent construction would simply substitute electric tubular heaters. Drain outlet 12 is positioned at the substantially lowest portion of drain pan 8 and is connected at joint 36 by drain fitting 20 to drain pipe 24. Drain pipe 24 includes trap 26 and outlet 34. Thermally attached to fitting 20 is the coil hot gas inlet tube 14. This hot gas inlet tube has a connection 16 to the coil piping which is not shown. The hot gas supply conduit 18 is connected to the coil hot gas inlet tube 14 at joint 36. The outlet portion of drain pipe 24 which includes trap 26 is heated by electric heater 30 connected by wires 32 to a source of electricity to maintain the washer 28 in trap 26 in a liquid condition regardless of external conditions. The drain tube and the hot gas tube are arranged to traverse the insulated wall 22 of the freezer at opening 38. The gap between the tubes and the wall insulation is generally filled with a mastic or insulant which is not shown. In the event that the ambient surrounding the trap falls below the freezing point of water 32° F. (0° C.) and simultaneously the heater 30 or its power supply fails to function, because of a blown fuse, or other power failure, or because the heater failed earlier without anyone noticing, then the water 28 residing in trap 26 will freeze. On the occurrence of a defrost of coil 2 at or soon after such an occurrence, the meltage resulting from the defrosting coil 2 will fill tube 24 and drain pan outlet tube 20 progressively as subsequent defrosts occur. Eventually the drain pan 8 will be completely filled with ice; as continued defrosts occur, the meltage arising from the defrosted coil 2 will build up into the coil 2, surrounding tubes 6 and 4. Through repeated freezing and thawing activity generated by the operation of the defrost mechanism the ice will destroy or distort the metal structures of the coil 2 and the drain pan 8. Further even if the backing up of water and the formation of ice in drain pan 8 and in coil 2 does not result in any destruction of the evaporator, there will inevitably be a sharp reduction in refrigerating capacity of the coil 2. When the iced up condition is discovered, the service person will be obligated not only to thaw the drain line but to undertake the more time consuming and difficult operation of warming and thawing of all the ice in the coil and the drain pan.

Figure 2:
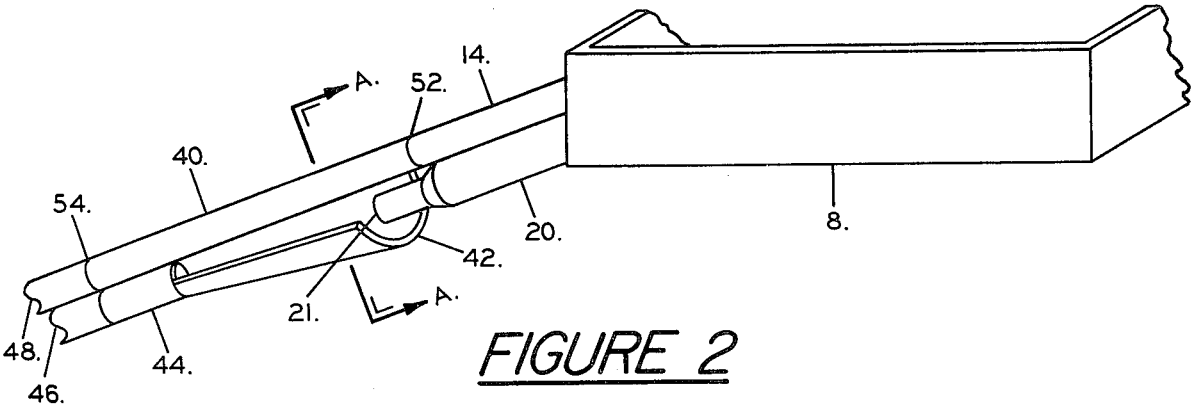
FIG. 2 is a partial view in isometric showing a drain assembly characteristic of one version of the invention which includes an open drain trough heated by the heating tube. The trough is arranged to accept meltage from the drain pan outlet and convey it to the drain pipe.

FIG. 2 shows one manifestation of the invention in an isometric representation of the lower end of drain pan 8. Drain fitting 20 is affixed to substantially the lowest point of the drain pan 8. Hot gas inlet tube 14 is thermally attached to drain fitting 20 as by a hose clamp so as to communicate its heat thereto during defrost periods. Drain fitting 20 has an outlet 21 which is positioned over trough 42. Trough 42 is an open channel formed of thermally conductive metal such as copper, one edge of which is thermally secured, as by soldering, to tube 40 which is a portion of the hot gas conduit connected to hot gas inlet pipe 14 at joint 52. The trough 42 is connected to outlet tube 44 which in turn is connected to drain pipe 46 which is routed to waste. Throughout its traverse through the cold space the meltage is heated by thermal communication with hot gas tube 48, 40, and 14.

Figure 3:
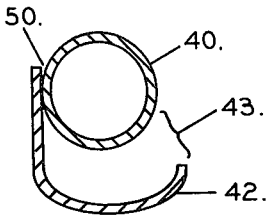
FIG. 3 is a cross section of the construction of FIG. 2 showing in greater detail the open trough or channel which constitutes the discontinuity.

FIG. 3 is a cross section at A—A of FIG. 2, showing the trough portion 42 connected at point 50 to hot gas tube 40 with an open space 43 which allows any possible overspill from trough 42 to freely occur.

In the situation that drain pipe 46 has been plugged with dirt or ice the meltage flowing through outlet fitting 20 through trough 42 to drain pipe 46 will gradually fill and therefore back up into said drain pipe when enough meltage has frozen and accumulated. Then, subsequent meltage from defrosting coil 2 will overspill the open portion 43 of trough 42 and will drip upon the floor and freeze. No build up of ice to the point where the closing of outlet 21 of fitting 20 can occur because the entire portion of trough 42 is warmed above freezing by thermal contact with hot gas tube 40.

Therefore, in the situation that drain line 44 has been plugged, personnel operating in the freezer in the routine performance of their duties of withdrawing and stacking merchandise will be altered to the drain problem, and will in turn alert the maintenance group so that corrective measures can be instituted.

Figure 4:
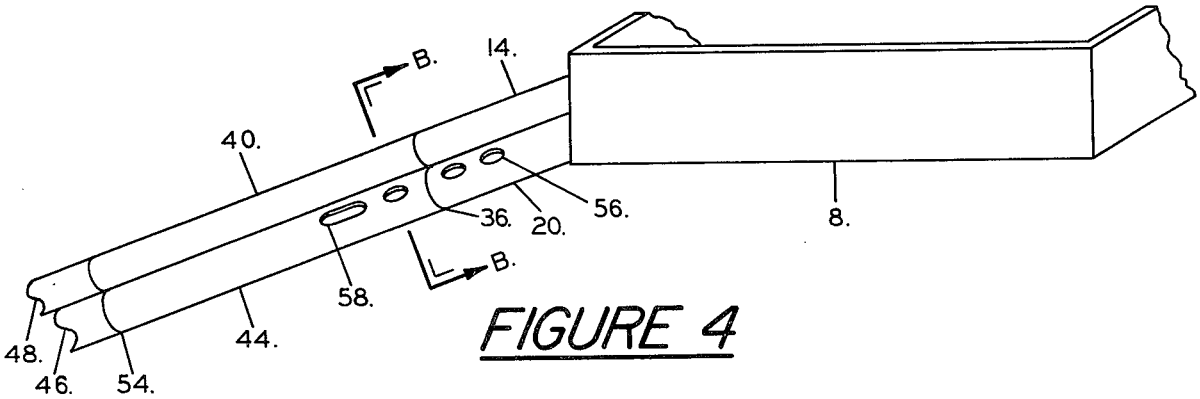
FIG. 4 is a partial isometric view of the end of the drain pan including the hot gas tube and the drain pipe and showing discontinuities in the form of holes and slots provided in the top portion of the drain pipe.

FIG. 4 shows a drain pan 8 like that of FIG. 2 with hot gas inlet 14 connected to hot gas tubes 48 and 40 and drain line 46 and supplementary drain tube 44 connected to outlet fitting 20. Outlet fitting 20 is fashioned with holes 56 located in the upper portion of its circumference. These holes 56 are closely oriented to the line of thermal connection between the outlet fitting 20 and the hot gas inlet tube 14. Typically the holes 56 are 0.25 inches (dia.) though larger or smaller holes may be serviceable.

In the event the outlet fitting 20 of drain pan 8 had no holes 56 present, a supplementary heated drain tube section comprising supplementary hot gas tube 40 and supplementary drain tube 44 is provided to be coupled to outlet fitting 20 and hot gas tube 14 at junction 36 to provide the desired function. Heated drain tube 44 incorporates slots 58. These slots 58 are positioned close to the line of thermal contact between supplementary drain tube 44 and supplementary hot gas tube 40 to provide the insurance that the slots 58 remained warm and free of ice throughout each defrost period so that meltage draining from drain pan 8 which could not exit from drain line 46 because said drain line was plugged with dirt or ice could overspill from slots 58 providing adequate warning to the personnel operating below that there was a drain line malfunction and that service was required.

Figure 5:
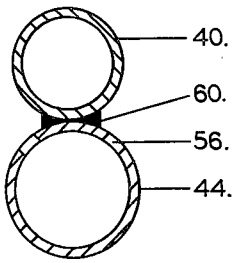
FIG. 5 is a cross section of the drain pipe of FIG. 4 showing the relative positions of the non-freeze holes and the heating tube.

FIG. 5 shows a cross section of the supplementary tubes 40 and 44 showing the soldered connection 60 between the two tubes and the holes 58 provided in the supplementary drain tube 44, positioned close to and on each side of the line of tangency between the two supplementary tubes to insure effective heating of the supplementary drain tube.

Figure 6:
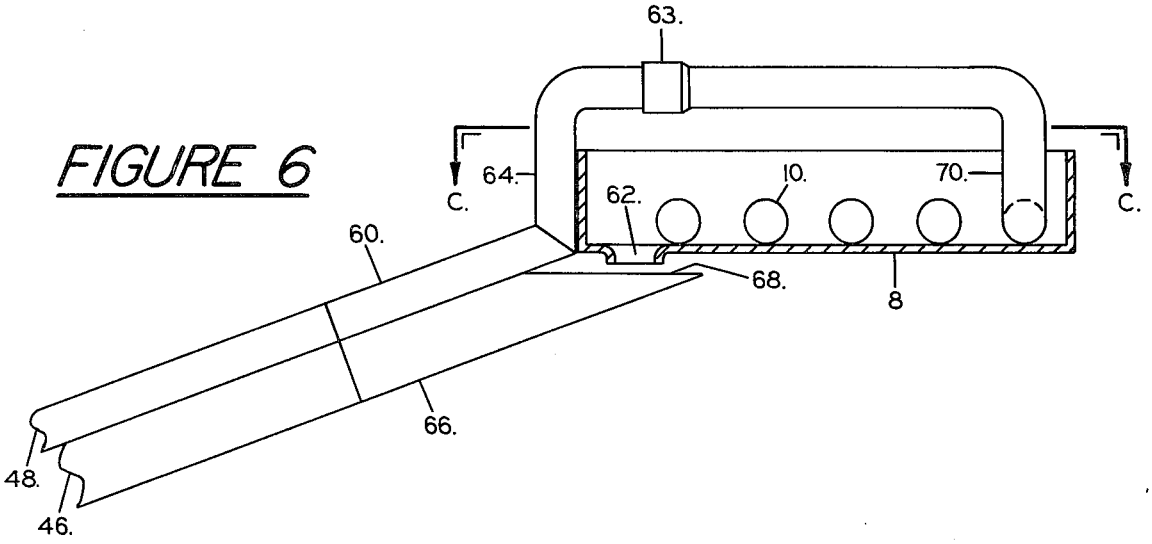
FIG. 6 is a cross section in elevation of the end of the drain pan showing a drain pipe which is effectively heated at its inlet end adjacent to the drain pan but which is not connected to the drain pan.

FIG. 6 is a side view in elevation of a simplified drain pan construction incorporating a heated supplementary drain assembly normally intended to be supplied by the manufacturer of the evaporator.

Drain pan 8 incorporates heating tubes 10, hot gas inlet fitting 62 communicating with first drain tube 70 which communicates in turn through connections not shown with remaining drain tubes 10. The supplementary drain assembly comprises drain tube 66 thermally bonded to hot gas inlet tube 64 at juncture 60. The drain tube 66 has its inlet end cut at a bevel to provide a substantially oval opening 68 which is positioned directly under drain pan outlet 62. Hot gas tube 48 and drain pipe 46 are subsequently connected to the supplementary drain assembly. Should the drain line 46 at any time become plugged with ice or dirt, the meltage will back up progressively filling drain line 46 and supplementary drain tube 66 to the point where meltage leaving drain pan 8 through outlet 62 overspills the supplementary drain tube 66 and overflows onto the floor, alerting operating personnel that there is a difficulty at that point.

Figure 7:
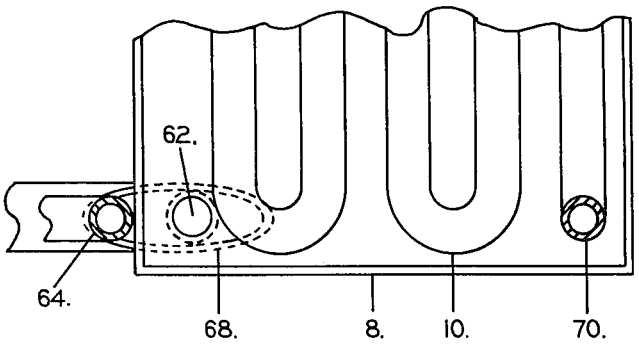
FIG. 7 is a plan view in section of a portion of FIG. 6 showing more clearly the details of construction.

FIG. 7 shows section C—C which is a plan view through the structure of FIG. 6 including hot gas line 64. The drain pan outlet hole 62 is positioned to lay immediately over the oval opening in the supplementary drain tube 66.

I claim:

1. Drain means for conveying water from a refrigeration cooling coil through a freezing environment to a non-freezing environment;

a drain pan including an outlet, said drain pan constituting means for receiving water from the coil and conveying it to the drain means;

said drain means having a plugged condition and an unplugged condition;

said drain means comprising means for conveying water to the non-freezing environment during the unplugged condition and heated means positioned within the freezing environment for diverting water out of the drain means during the plugged condition whereby water may flow freely from the drain pan during both the plugged and the unplugged conditions.

2. An improvement in drain means for conveying water from a refrigeration cooling coil through a freezing environment to a non-freezing environment;

said drain means having plugged and unplugged conditions;

a drain pan including an outlet, said drain pan constituting means for receiving water from the coil and conveying it to the drain means;

wherein the improvement comprises (a) drain means for conveying water to the non-freezing environment during the unplugged condition, (b) heated means positioned within the freezing environment for diverting water out of the drain means during the plugged condition, whereby water may flow freely from the drain pan during both the plugged and unplugged conditions.

3. In a water drainage system for conveying condensate from a refrigerating evaporator through an environment cooler than 32° F. (0° C.) to a non-freezing environment, said drainage system having plugged and unplugged conditions, the method of ensuring free flow from the evaporator during both plugged and unplugged conditions comprising the steps of:

(a) establishing a first flow path from the evaporator to the non-freezing environment for flow during unplugged conditions;

(b) establishing within the cold environment a heated second flow path for flow during plugged conditions.

4. Drain means as in claim 1 where the diverting means includes a trough.

5. Drain means as in claim 1 where the drain means is a conduit and the diverting means is a hole in the upper periphery of the conduit.

6. Drain means as in claim 1 where the heated means for diverting water out of the drain means during the plugged condition constitutes heated flow means positioned beneath but substantially unconnected to the drain pan outlet.

* * * * *